US009328454B2

(12) United States Patent
Adkins et al.

(10) Patent No.: US 9,328,454 B2
(45) Date of Patent: May 3, 2016

(54) ELECTRIC IRON WITH NOZZLE FOR WATER MIST

(75) Inventors: George Ralph Adkins, Rotherham (GB); Michael James, Rotherham (GB); Jamie Michael Sellors, Rotherham (GB)

(73) Assignee: MORPHY RICHARDS LIMITED, Rotherham (GB)

( * ) Notice: Subject to any disclaimer, the term of this patent is extended or adjusted under 35 U.S.C. 154(b) by 0 days.

(21) Appl. No.: 13/988,134

(22) PCT Filed: Oct. 28, 2011

(86) PCT No.: PCT/EP2011/069024
§ 371 (c)(1),
(2), (4) Date: May 17, 2013

(87) PCT Pub. No.: WO2012/065832
PCT Pub. Date: May 24, 2012

(65) Prior Publication Data

US 2014/0082979 A1 Mar. 27, 2014

(30) Foreign Application Priority Data

Nov. 17, 2010 (GB) ..... 1019441.3

(51) Int. Cl.
*D06F 75/22* (2006.01)
*D06F 75/06* (2006.01)

(52) U.S. Cl.
CPC ..... *D06F 75/22* (2013.01); *D06F 75/06* (2013.01)

(58) Field of Classification Search
CPC ..... D06F 75/08; D06F 75/22; D06F 75/06; B05B 1/00; B05B 1/02; B05B 1/10; B05B 1/30; B05B 1/302
USPC ..... 38/74, 77.83
See application file for complete search history.

(56) References Cited

U.S. PATENT DOCUMENTS

| | | | | | |
|---|---|---|---|---|---|
| 1,649,507 | A | * | 11/1927 | Brewer | 38/77.1 |
| 1,869,675 | A | * | 8/1932 | Easley | 38/77.6 |
| 2,271,686 | A | * | 2/1942 | Fitzgerald | 38/77.1 |
| 2,294,578 | A | * | 9/1942 | Shapiro et al. | 392/396 |
| 2,817,169 | A | * | 12/1957 | Schott | 38/77.1 |
| 3,041,756 | A | | 7/1962 | Foster | |
| 3,248,813 | A | * | 5/1966 | Quick | 38/77.6 |
| 3,264,764 | A | * | 8/1966 | Vieceli | 38/77.5 |
| 3,292,283 | A | * | 12/1966 | Hanner | 38/77.2 |
| 3,468,043 | A | * | 9/1969 | Turner | 38/77.1 |
| 3,664,045 | A | * | 5/1972 | Walker et al. | 38/77.5 |
| 3,685,182 | A | * | 8/1972 | Davidson et al. | 38/77.3 |
| 3,691,660 | A | * | 9/1972 | Gronwick et al. | 38/77.83 |
| 3,733,725 | A | * | 5/1973 | Trouilhet | 38/77.5 |
| 5,842,295 | A | * | 12/1998 | Ching et al. | 38/77.6 |
| 6,009,645 | A | * | 1/2000 | Shimizu et al. | 38/77.5 |
| 6,035,563 | A | | 3/2000 | Hoeffer et al. | |

(Continued)

FOREIGN PATENT DOCUMENTS

| | | | |
|---|---|---|---|
| AU | 2011331431 | B2 | 5/2012 |
| AU | 2011331431 | B2 | 5/2013 |

(Continued)

*Primary Examiner* — Ismael Izaguirre
(74) *Attorney, Agent, or Firm* — GrayRobinson, P.A.

(57) ABSTRACT

An electric hand iron comprises an electrically heated sole plate and an electrically operated water nozzle. The water nozzle is arranged to produce a water mist which produces a substantially uniform density moisture pattern, in response to a user activated control.

17 Claims, 20 Drawing Sheets

(56) References Cited

U.S. PATENT DOCUMENTS

| | | | | |
|---|---|---|---|---|
| 6,128,839 | A * | 10/2000 | Debourg et al. | 38/77.8 |
| 2004/0256482 | A1 | 12/2004 | Van der Linden | |
| 2005/0278986 | A1 | 12/2005 | Almanzar | |

FOREIGN PATENT DOCUMENTS

| | | | | |
|---|---|---|---|---|
| AU | 2011331431 | B2 | | 11/2013 |
| AU | 2011331431 | B2 | | 12/2013 |
| AU | 2011331431 | B2 | | 3/2014 |
| EP | 1043441 | | * | 10/2000 |
| EP | WO2006067752 | A2 | | 6/2006 |
| EP | 2012065832 | A2 | | 5/2014 |
| GB | 1019441.3 | | | 3/2011 |
| GB | 2485553 | B | | 5/2012 |
| GB | 1019441.3 | | | 1/2013 |
| GB | 1019441.3 | | | 3/2013 |
| GB | 1019441.3 | | | 6/2013 |
| GB | 1019441.3 | | | 11/2013 |
| JP | 411244600 | A | * | 9/1999 |
| WO | 2007/054432 | A1 | | 5/2007 |
| WO | 2010/130548 | A1 | | 11/2010 |

* cited by examiner

ELECTRIC IRON WITH NOZZLE FOR WATER MIST

CROSS-REFERENCE TO RELATED APPLICATIONS

This application is a national phase entry of international application no. PCT/EP2011/069024, filed Oct. 28, 2011 under the Patent Cooperation Treaty, which claimed priority of patent application no. 1019441.3, filed Nov. 17, 2010.

FIELD OF THE INVENTION

The present invention relates to hand irons.

BACKGROUND TO THE INVENTION

Conventional hand irons for ironing clothes include dry irons, wet irons, and steam irons. These include the following types.

Self contained hand held steam irons. These irons have an internal reservoir and a steam producing heating space within the body of the hand held iron, which generates steam within the iron. Water is passed from the reservoir to the heating space to generate steam, which vents through a set of steam outlet apertures arranged in the sole plate.

Steam irons with a steam station. These irons have a separate base unit, known as a "steam station", which has a larger capacity water reservoir. Water is passed through a flexible tube to the hand iron, where it is heated to produce steam. The steam is vented through a set of apertures in the sole plate. The large capacity water reservoir in the separate steam station permit a relatively light weight hand iron, and fewer stoppages to fill the reservoir, and the steam is generated at the iron from water obtained form the base unit.

Steam irons with a steam generator. These irons have a separate steam generator unit having a large capacity reservoir and a steam generator unit. Steam is passed through a flexible tube to the hand iron and is vented through a set of apertures in the sole plate. There may be a re-heat chamber in the iron itself to vaporize any condensate at the hand iron and convert it to steam. The large capacity water reservoir and separate steam generator permit a relatively light weight hand iron, and fewer stoppages to fill the reservoir.

Hand irons with a water spray. These irons have an internal reservoir, a pump and a water spray nozzle. The pump can either be electrical or mechanical. Water is pumped from the reservoir to the nozzle which is usually situated at the front of the iron and water is sprayed from the front of the iron onto the garment. The hot sole plate vaporizes the water on the garment into steam when the sole plate passes over the wetted portion of garment.

The latter of these types, referred to herein as "wet irons" or "spray irons" suffer from problems as follows:

In the case of hand pumped spray irons, coverage of the garment with water spray depends upon manual pressing of a button which activates a pump to generate a spray. This can result in a non-even coverage of water spray on the garment.

For spray irons with electrically or mechanically operated pumps, the nozzle can suffer from dripping and leakage of large water droplets. Instead of an even spray being generated, sometimes the nozzle squirts a jet of water onto the garment, or can create a spray in which there are some relatively larger droplets of water, creating an uneven wetting of the garment.

Specific embodiments presented herein aim to address the above problems.

SUMMARY OF THE INVENTION

According to a first aspect, there is provided an electric hand iron comprising:

an electrically heated sole plate;

a water nozzle situated in front of the iron and directed in front of the iron, and an electric pump for supplying water to said nozzle, characterised in that said water nozzle is arranged to produce a water mist having a substantially uniform distribution of water droplets and wherein said nozzle produces a mist having an average droplet diameter in the range 39 μm to 159 μm.

Preferably, said water nozzle is arranged to produce a water mist which, when settled on a surface to be ironed, produces a layer of moisture on top of said surface of a substantially uniform of thickness.

Said nozzle is suitably positioned relative to a foremost point of the soleplate so that a mid point of the nozzle is positioned in front of the foremost point of the soleplate.

Preferably said nozzle produces a mist having an average droplet diameter in the range 58 μm to 100 μm.

Said water nozzle may have an outlet aperture with a maximum diameter in the range 0.6 mm to 0.8 mm.

The iron preferably further comprising an electrically operated pump which supplies water to said water nozzle.

The iron may, comprise an in-line filter having a mesh aperture size having dimensions in the range:

Width: 65 μm to 85 μm;

Length: 110 μm to 200 μm.

Said mist may form a substantially elliptical spray pattern on a flat surface parallel with an underside of said sole plate, said substantially elliptical pattern being positioned in front of a tip of said sole plate.

Said elliptical spray pattern may have an area with dimensions in the range:

minimum width 65 mm to 70 mm;

maximum width 90 mm to 95 mm;

minimum length 75 mm to 80 mm;

maximum length 100 mm to 105 mm.

Said nozzle may be positioned to form said mist of water in front of a sole plate of said iron.

Said nozzle may be positioned above a tip of said sole plate, and a mid point of the said nozzle is positioned a distance of between 5 mm and 15 mm in front of a foremost point of said sole plate.

Said nozzle may be positioned above a tip of said sole plate at a height in the range 75 mm to 80 mm.

The iron preferably comprises a valve which opens when an inlet water pressure rises above a pre-determined level, and which shuts when said water pressure drops below said pre-determined level.

The iron may comprise a reservoir, wherein said water reservoir is situated in a body of said iron.

The iron may further comprise a water station which is a separate unit from said hand iron and wherein water is supplied from said separate water reservoir to said hand iron via a flexible pipe or tube.

Preferably said nozzle operates at a flow rate in the range 25 milliliters to 30 milliliters per minute.

Preferably, said nozzle operates at a pressure within the range 4 bar to 7 bar.

Preferably the iron further comprises a pressure regulator for regulating a pressure of water supplied to said nozzle.

Preferably the iron comprises a an electrically operated illumination means positioned so as to shine a light spot or pattern in front of said sole plate at a position coincident with a position of said mist pattern.

Other aspects are as described in the claims herein.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Specific embodiments herein aim to create a water mist, which is not a gas or steam, but rather which is a fine mist of water droplets which are more uniform in size and drop volume than have been hitherto commercially available, and which provides a more uniform spray pattern onto a garment.

The embodiments aim to produce a water mist which settles on the fabric to be ironed, without drenching or over wetting the fabric, but at the same time containing enough water to make sufficient steam to fully permeate through the fabric being ironed, when the iron is being moved forward or backwards in normal ironing use. Localised flooding or concentrations of water globules, or uneven wetting are to be avoided. Rather, an objective is to achieve a fine layer of small water droplets or particles which sit on top of the fabric, and which are immediately vaporised to form steam as the hot sole plate of the iron moves over the wetted region of fabric. Ideally, the water settling on the surface of the fabric should be just enough to completely evaporate when the iron moved over the wetted region, so that the ironed fabric is dry after ironing.

Ideally a uniform thickness layer of water and/a uniform density of water layer will form on top of the fabric, without the water soaking in to the fabric.

By providing a more uniform density of water particles, a greater degree of control of the amount of water, the density of water, and the area coverage of water may be provided. As the water settles on the fabric the moisture droplets may be heated by the sole plate to provide steam locally which permeates the fabric locally, thereby effectively providing a localised steam effect, but without the need to generate steam in the iron, thereby saving the weight and bulk of a separate steam generator whether in a hand held iron, or in a separate steam station.

Additionally, the embodiments herein may have an advantage over a conventional steam generator & steam iron combination or a conventional steam iron having a water reservoir and a heating chamber in the iron, of being able to produce a similar performance, but without the build up of scale which can be problematic in a steam generator or a self contained steam iron.

Further, it is anticipated that the embodiments herein may use less water for the same amount of ironing compared to a conventional steam generator plus steam iron combination, and therefore require less interruption for filling the reservoir.

Figure 1:
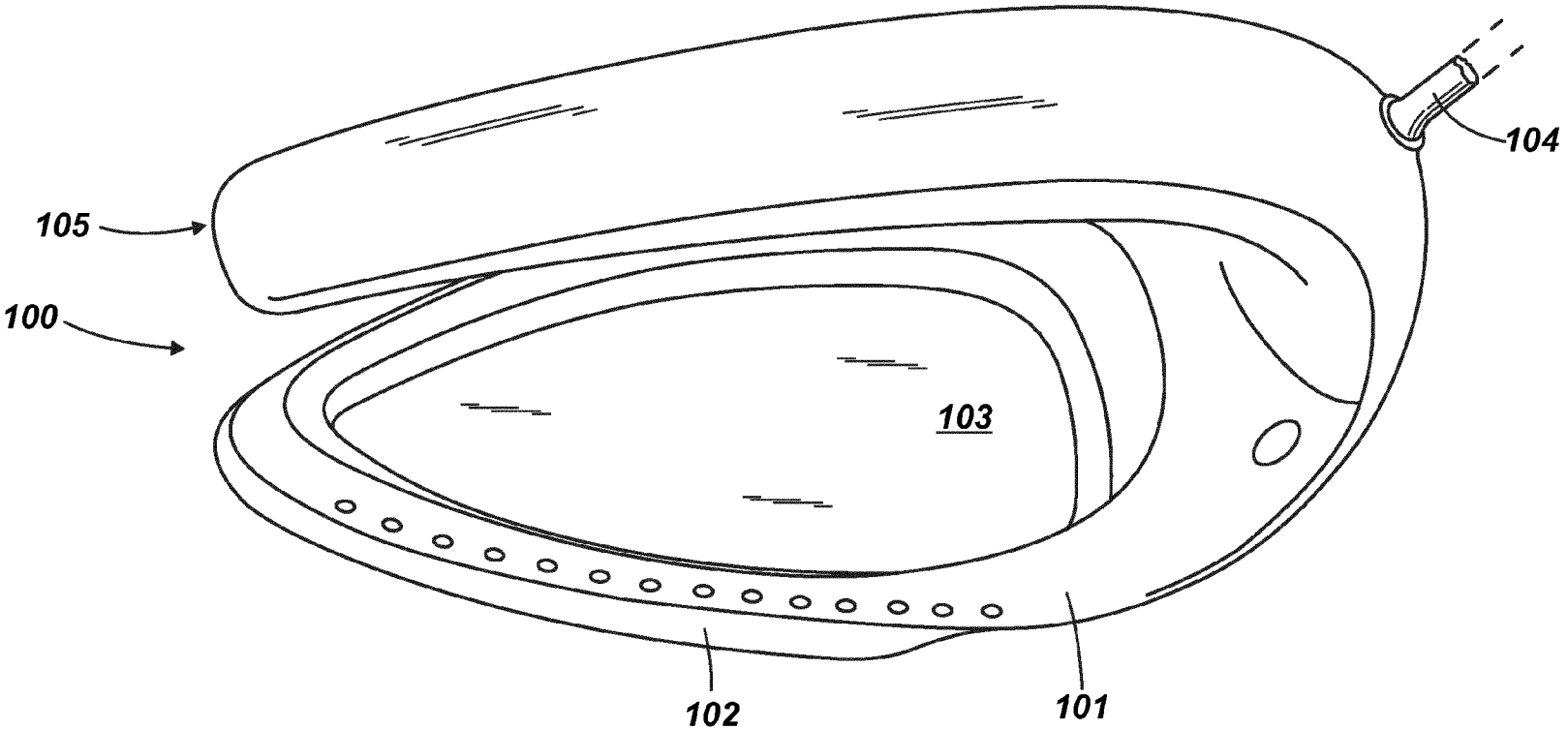
FIG. 1 herein illustrates schematically in view from one side a first embodiment iron having an improved water nozzle.

Referring to FIG. 1 herein, there is shown in view from one side, a hand iron according to a first specific embodiment. The hand iron 100 comprises an outer casing 101 of a plastics material for example polycarbonate; a glass, ceramic or metal sole plate 102; an upper cowl 103 covering the sole plate; an umbilical cord 104 containing an electric heating element for heating the sole plate; an electric power supply cable for supplying electrical power to the iron and a flexible plastics tube for supplying water to the iron; and a nozzle 105 positioned at a forward end of the handle.

Within the handle is contained a water filter for filtering the water received via the umbilical cord 104, and optionally a water pump for pumping the water to the nozzle. The filter is positioned up stream of the pump so as to clean the water entering the pump, because particles in the water of dimension 0.5 mm or more can have a detrimental effect on the operation of the pump, and can clog up the pump. There is also a control circuit within the body of the iron for controlling the water spray from the nozzle and a hand operated switch for activating the spray from the nozzle.

When the user activates the control switch, the pump and valve are activated to pump water to the nozzle, which generates a fine mist, spray or an aerosol of water which is directed immediately in front of the tip of the iron on to a garment or fabric to be ironed.

Figure 2:
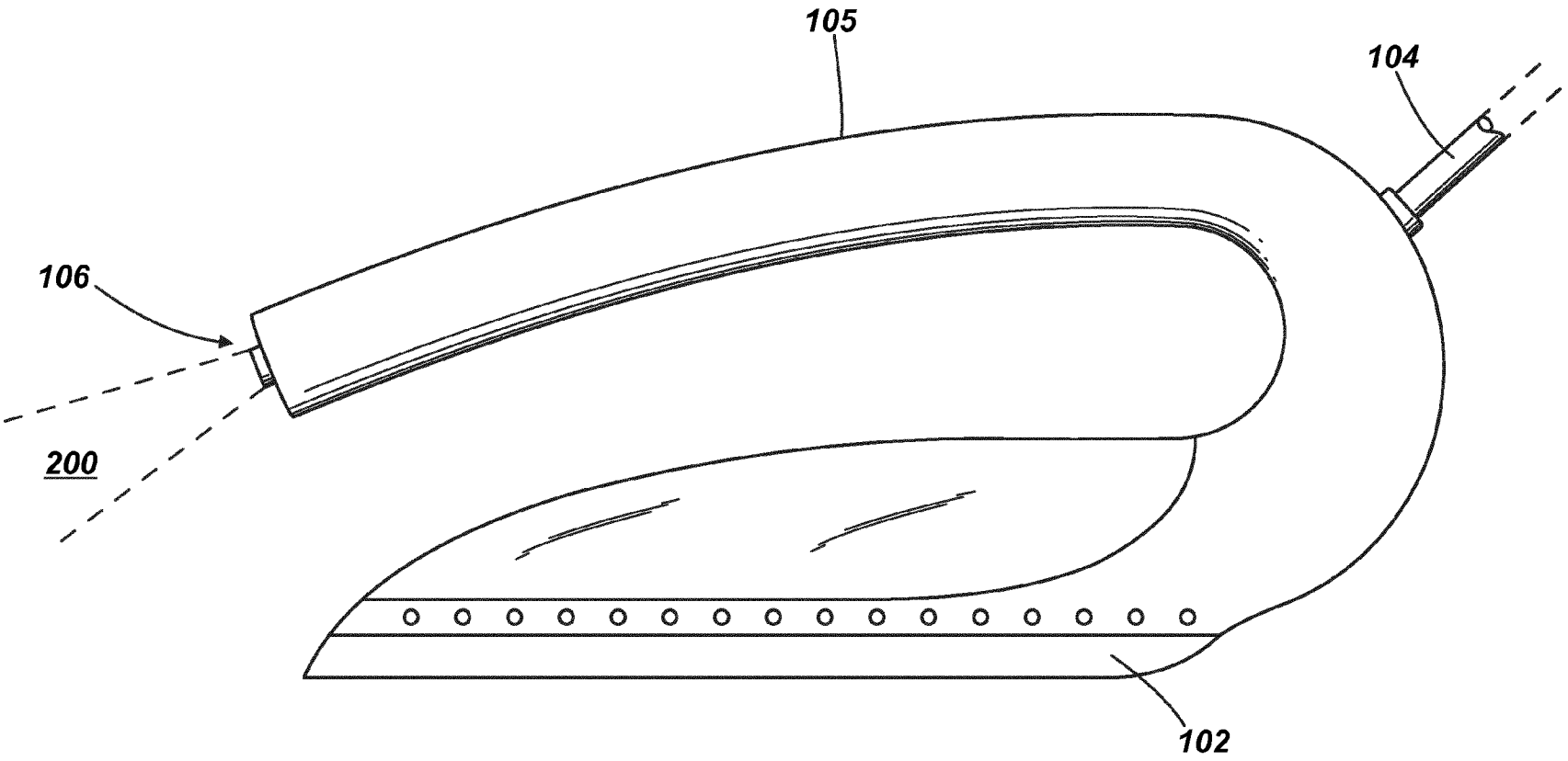
FIG. 2 illustrates schematically in view from one side, the first embodiment iron of FIG. 1.

Referring to FIG. 2 herein, there is illustrated schematically in view from one side the first embodiment iron of FIG. 1 herein.

Water is received via the umbilical cord 104, passes through the handle 105 to the water outlet nozzle 106 and forms a fine water mist or spray 200 which is directed forwardly of the iron to form a moisture pattern on a garment or fabric in front of the tip of the sole plate.

Figure 3:
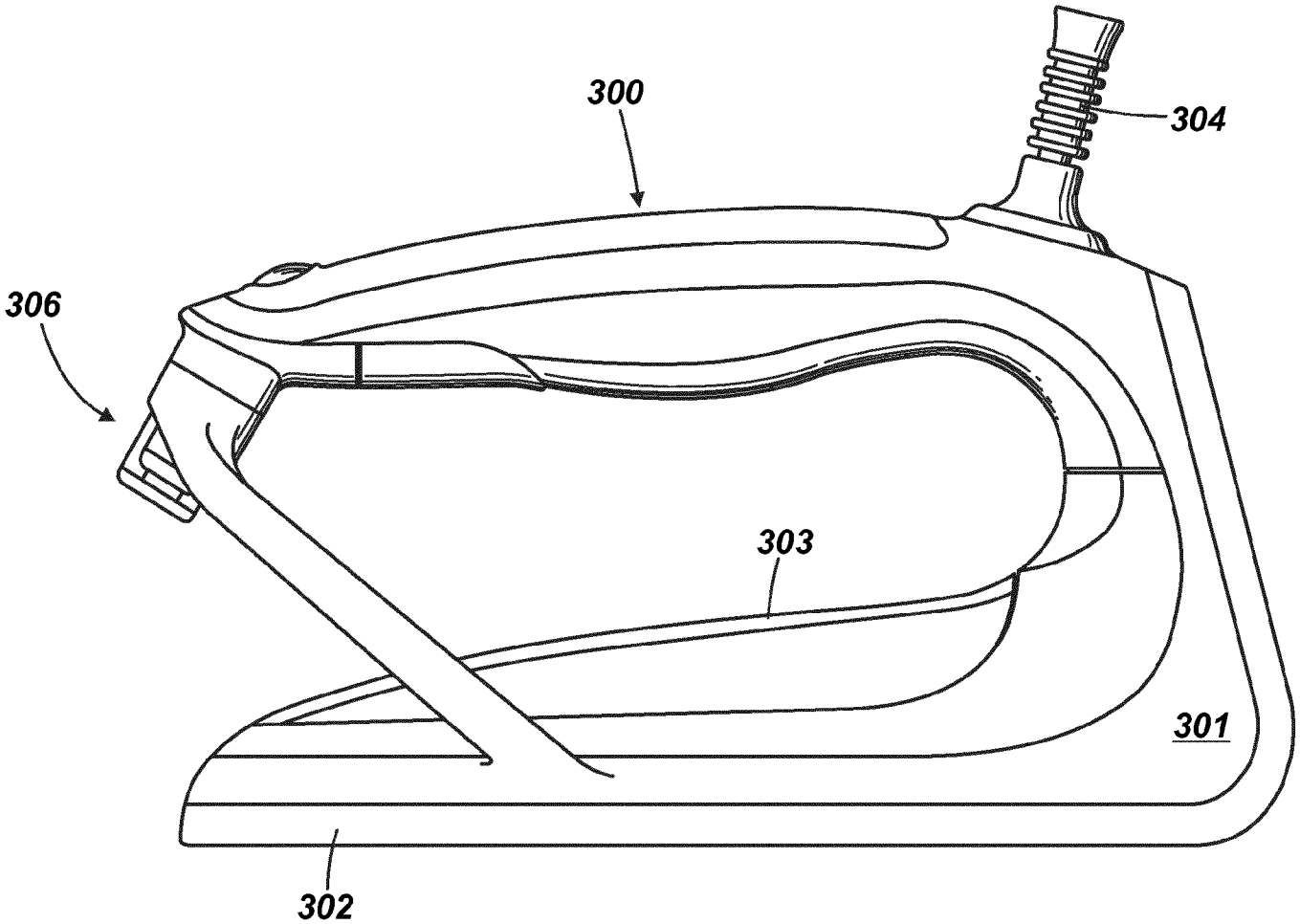
FIG. 3 illustrates schematically in view from one side a second embodiment iron having an improved water nozzle.

Referring to FIG. 3 herein, there is shown in view from one side a second hand iron according to a second specific embodiment. The second hand iron 300 comprises an outer casing 301 of a plastics material, for example polycarbonate; a glass, ceramic or metal sole plate 302; an upper cowl 303 covering the sole plate; an electric heating element for heating the sole plate; an umbilical cord 304, comprising an electric power supply cable for supplying electrical power to the iron; one or a plurality of support spars 305 connecting the front of the iron casing to a front portion of the handle; and a vapor or mist creating water nozzle 306 positioned at a forward end of the handle.

Similarly as with the first embodiment iron, water is received via the umbilical cord, passes through the handle to the water outlet nozzle at the tip of the handle, and forms a fine water mist or spray which is directed forwardly of the iron to form a moisture pattern on a garment or fabric in front of the tip of the sole plate.

Figure 4:
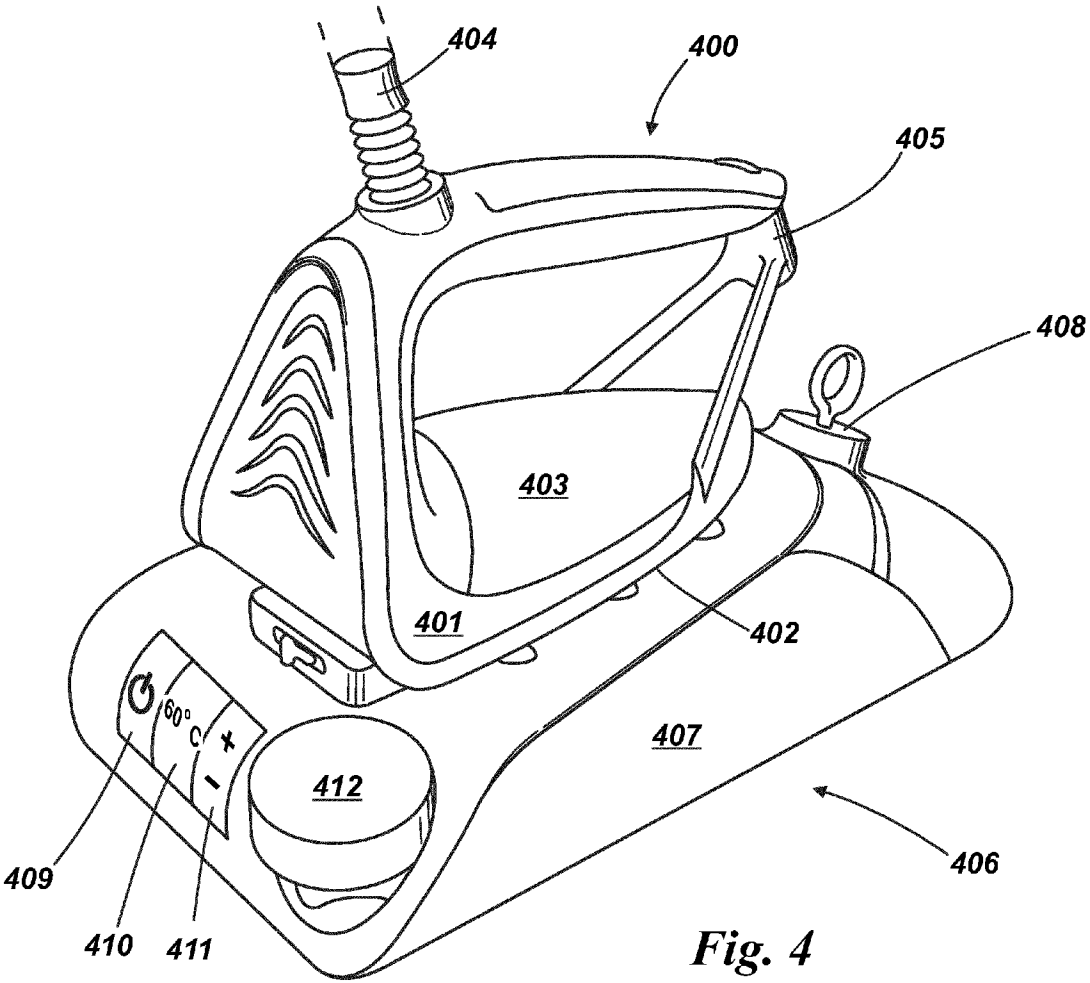
FIG. 4 illustrates schematically in perspective view, an iron having an improved water nozzle, and a water station according to a third specific embodiment.

Referring to FIG. 4 herein, there is illustrated schematically a hand iron and water station according to a third specific embodiment.

Hand iron 400 comprises an outer casing 401 of a plastics or polycarbonate material; a glass, ceramic or metal sole plate 402; an upper cowl 403 covering the sole plate; an electric heating element for heating the sole plate; an electric power supply cable 404 for supplying electrical power to the iron; and a vapor nozzle 404 positioned at a forward end of the handle.

Water station 406 comprises an external casing 407 formed so as to have a platform upon which the iron can be securely placed or rested; an internal water reservoir; a fill aperture 408 for filling the reservoir with water; a filter which can be fixed or removable/replaceable for cleaning; 4 an on/standby switch 409; a temperature display 410, which can be a liquid crystal display or a light emitting diode display for example; a touch sensitive temperature control 411; an electric cable and mains plug 412 for providing power to the iron, and wherein the cable is either spring retractable into the casing, or can be folded and stored in the casing; and an umbilical cord connecting the water station to the hand iron, the umbilical cord comprising a electrical cable for carrying mains power to the hand iron and a flexible rubber tube for carrying water.

Figure 5:
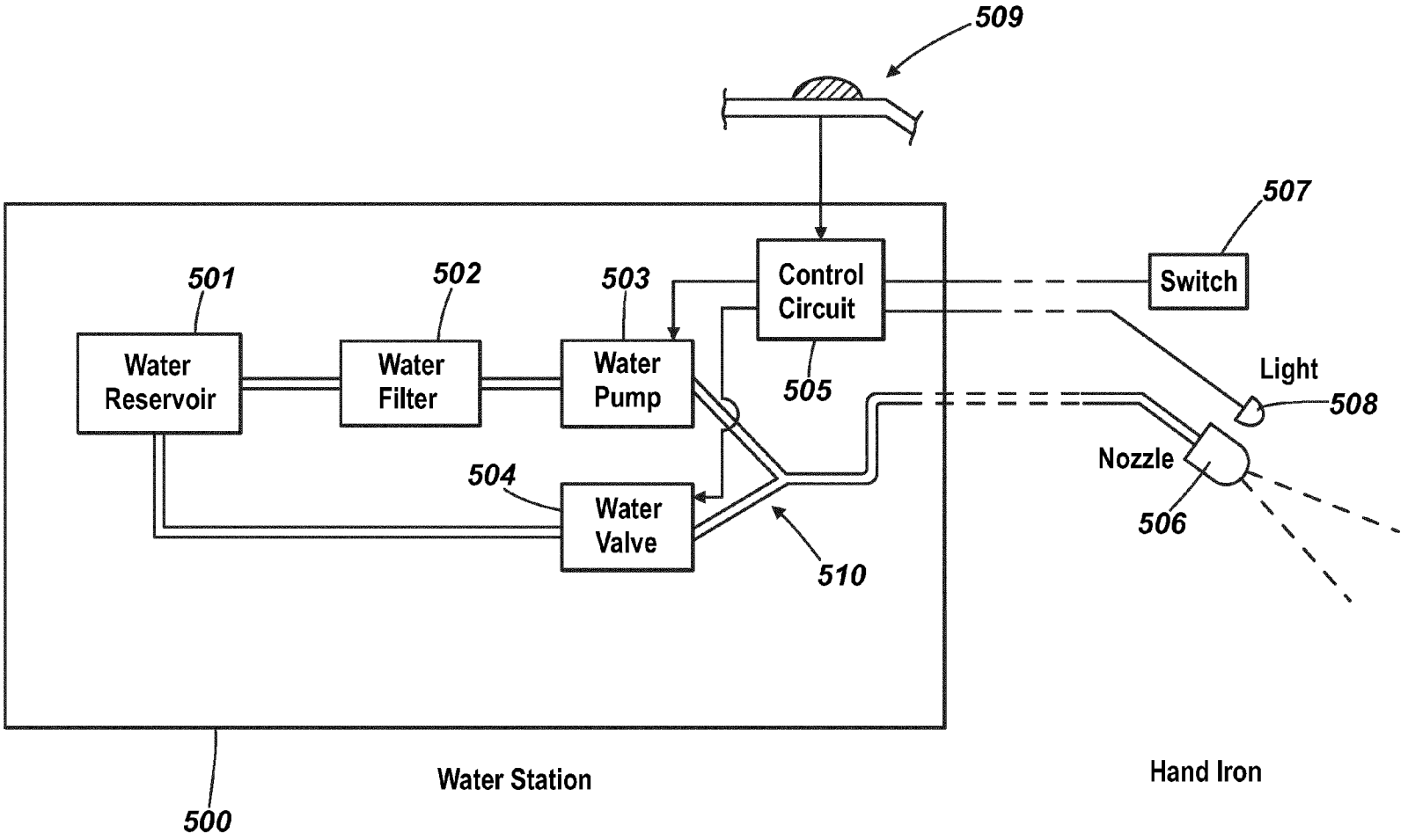
FIG. 5 illustrates schematically components of the iron and water station of FIG. 4 herein.

Referring to FIG. 5 herein, there is illustrated schematically components of the hand iron and water station as shown in FIG. 4 herein.

The water station 50 comprises a water reservoir 501 a water filter 502, an electrically operated water pump 503, a water valve 504, a control circuit 505, a nozzle 506, an electrically operated switch 507; one or a plurality of illumination means 508; and an additional indicator means 509 positioned on top of the handle of the iron.

The water pump and water valve 504 are connected by a "Y" tube 510 to the nozzle 506. Water is pumped out of the nozzle by the pump upon activation of the control switch 507. The switch is conveniently placed under the user's finger on the handle so that the pump can be easily activated by a user during ironing. For example, the controls may be positioned such that it is easy for a user to press the switch on a forward sweep of the iron, so that as the iron moves forward, the sole plate moves over a region of fabric which has just been wetted by moisture from the mist which emits from the nozzle.

The water filter receives water from the reservoir and filters it. The water filter preferably comprises a nylon or metal mesh having a substantially rectangular mesh aperture size of around 150 μm to 75 μm (approximately 0.006 inches×0.003 inches). The water atomises in to a fine mist when it leaves the nozzle, and forms a mist having a mean droplet size in the range 50 μm to 100 μm, and typically around 77 μm.

The water pump pumps filtered water from the reservoir to the nozzle. The valve 504 prevents dripping of water from the nozzle when the pump is turned off, so as to avoid drips of water leaking from the nozzle at the end of an operation of the nozzle. Water can either pass to the nozzle, or be diverted by the valve back to the water reservoir. Both the water pump and the valve are controlled by the control circuit 605.

In a variation of the fourth embodiment, there may be provided a spotlight 508 in the form of a light emitting diode, an incandescent filament bulb, or the like positioned at the tip of the handle, which illuminates an area in front of the iron, where the spray or mist is directed to fall. The light may have a directional beam, configured to coincide with a volume of space occupied by the spray or mist.

The indicator means 509 on top of the handle, which may comprise a light emitting diode, or a conventional light bulb for example, may indicate that the sole plate is at its working temperature, when "off", or may indicate for example, that the sole plate is warming up to operating temperature when "on". The indicator may be arranged to flash on/off during warm up or to indicate an operating condition of the iron.

Figure 6:
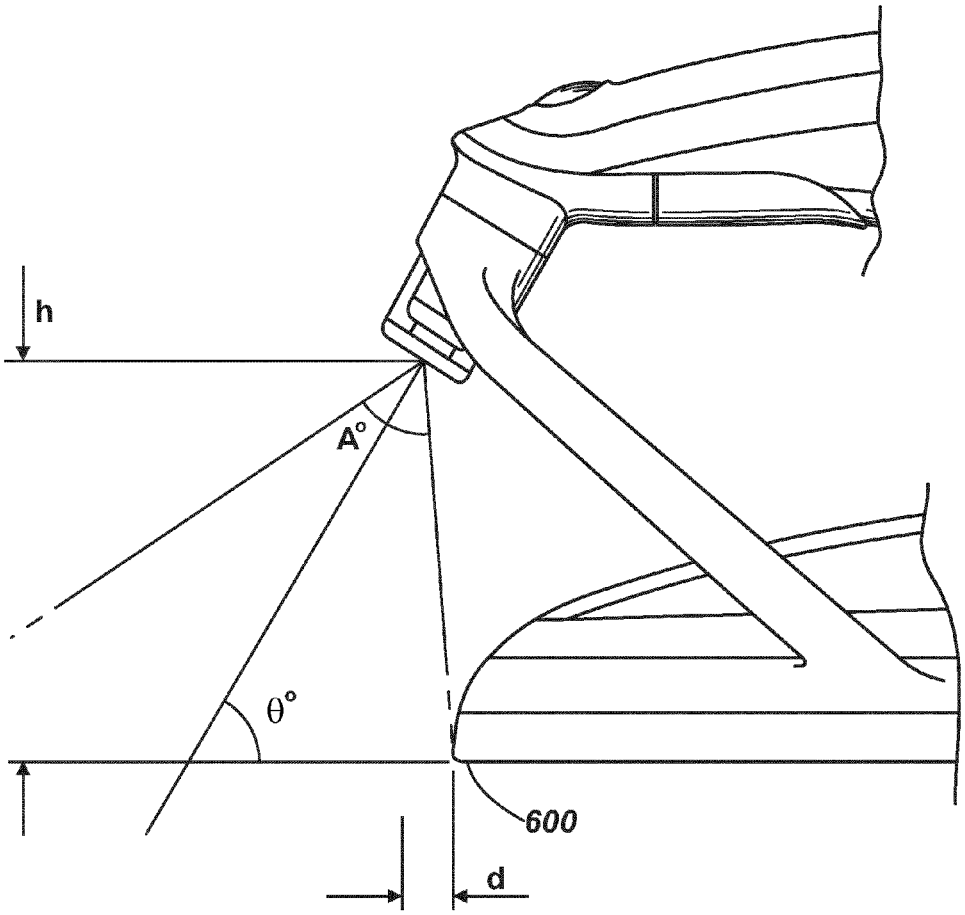
FIG. 6 illustrates schematically in view from one side, a positioning and geometry of the water nozzles of the second and third embodiment irons.

Referring to FIG. 6 herein, there is illustrated schematically some basic parameters of orientation of the nozzle.

The distance d represents the distance of the centre of the nozzle forward or aft or the forward most tip 600 of the sole plate. By varying this distance backwards or forwards moves the centre of the mist pattern forwards or backwards relative to the position of the sole plate, and therefore affects the distance of the moisture patch from the sole plate when the iron is stationary.

The height h of the nozzle outlet relative to the plane of the under surface of the sole plate affects the area of the patch of mist which settles on the garment or fabric to be ironed.

The angle θ of a central line of symmetry through the nozzle aperture, relative to the plane of the underside of the sole plate affects the angle at which the mist pattern is sprayed onto the garment or fabric, or also the shape of the moisture pattern formed on the fabric. A more shallow angle for θ results in a relatively more elliptical shaped moisture pattern settled on the fabric, whereas an angle θ=90°, for a nozzle which ejects a mist in a solid cone, would give a circular moisture pattern. The angle θ also affects the relative density of moisture of the mist pattern. A relatively more stretched elliptical shape may have a greater variation in moisture content per unit surface area than a circular moisture pattern. For a substantially elliptical shape, the relatively less dense water content per unit square occurs relatively further from the tip 600 of the sole plate than the relatively higher moisture density per unit square in front of the tip of the sole plate.

The angle A, being the angle of divergence of the mist emitted from the nozzle may be varied. A relatively larger angle A gives a relatively larger spray pattern, whereas a relatively more acute angle A gives a relatively smaller moisture pattern and therefore a relatively higher density of moisture per unit square of fabric.

Through experimentation, the inventors have identified the following ranges of parameters as being advantageous for most conditions of ironing occurring in domestic use:

| Parameter | Range |
|---|---|
| Height h of nozzle aperture above ironing surface. | 75 mm to 80 mm. |
| Conical angle A of mist from centre line of nozzle. | 30 degrees to 60 degrees, and preferably in the range 54 degrees to 57 degrees. |
| Distance d of centre of nozzle ahead of tip of sole plate. | 0 mm to 20 mm, and preferably in the range 0.6 mm to 6.5 mm. |
| Angle 0 of inclination of centre line of symmetry of nozzle aperture to plane of soleplate surface. | 25 degrees to 30 degrees. |

Figure 7:
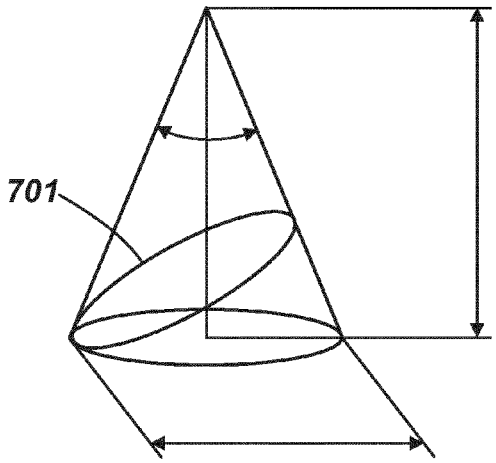
FIG. 7 illustrates schematically a conical water spray pattern emitted by a water nozzle described herein before.

Referring to FIG. 7 herein, there is illustrated schematically a geometric cone, being the shape of water spray, mist or aerosol which sprays onto a fabric, from a nozzle having its main central axis positioned vertically, or in a plane tangential to a plane of the sole plate. In practice, since the main central axis of the nozzle is angled, a shape of spray pattern from the nozzle which is incident on the fabric will be a cross section at an angle across the cone, where the main plane of the sole plate intersects the cone, resulting in an elliptical or near elliptical spray pattern. The two main axes of the ellipse and their relative dimensions are determined by the angle between the main axis of the cone, corresponding to the main central axis of the nozzle, and the plane of the sole plate, an example being shown as ellipse 701 in FIG. 7.

Figure 8:
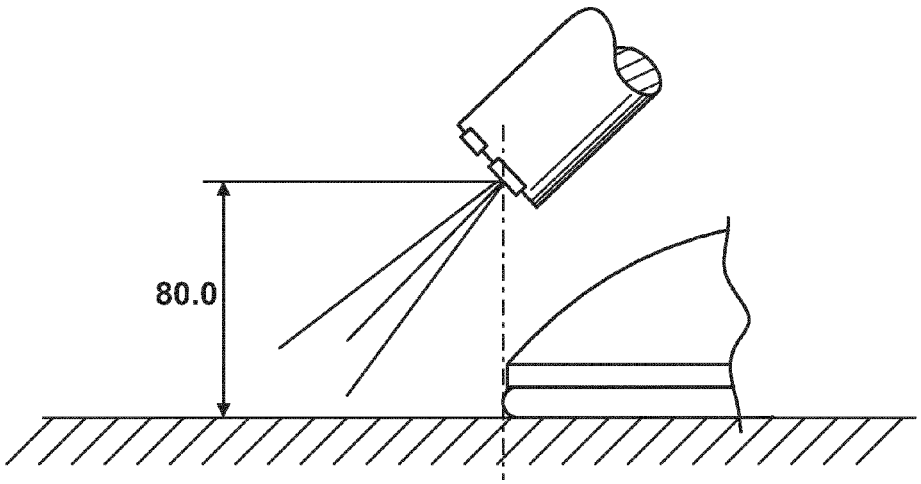
FIG. 8 illustrates schematically a second positioning and geometry of a water nozzle according which can be alternatively employed in the embodiments herein.

Referring to FIG. 8 herein, there is illustrated schematically an alternative positioning of a nozzle relative to a tip of a sole plate, in which the main central axis of the nozzle is angled with respect to the plane of the sole plate, and the nozzle lies immediately above the foremost tip of the sole plate. In this embodiment, the height of the nozzle outlet above the main plane of the sole plate is of the order 70 mm to 100 mm, and preferably around 80 mm.

Referring to FIG. 9 herein, there is illustrated in plan view 3 examples of moisture patterns formed in a plane occupied by a lower surface of the sole plate of an embodiment iron as described herein. Where the iron is placed upon a flat surface, the moisture patterns will form as shown.

Figure 9C:
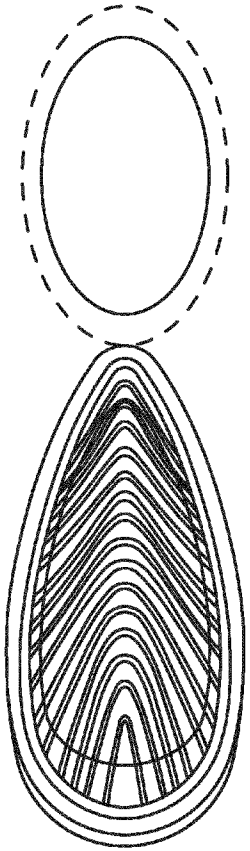
FIG. 9C illustrates schematically a third positioning of a water pattern in front of a sole plate.
Figure 9B:
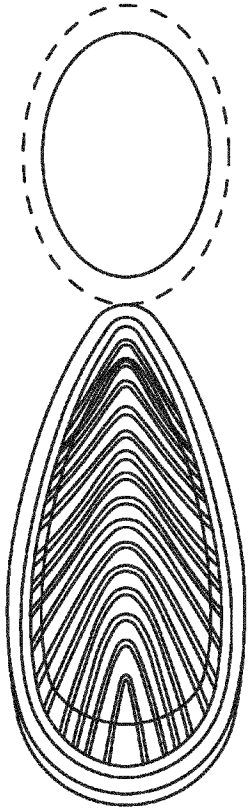
FIG. 9B illustrates schematically a second positioning of a water pattern in front of a sole plate.
Figure 9A:
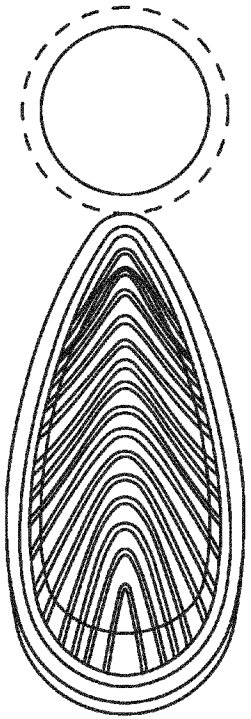
FIG. 9A illustrates schematically a first positioning of a water pattern in front of a sole plate.

In FIG. 9A there is shown a substantially circular mist pattern. The solid circular line in FIG. 9A is used for illustration purposes only, and denotes a line of substantially constant moisture level per unit area. Depending upon the configuration of the nozzle the actual moisture per unit area may vary across the diameter of the circular moisture patch, for example the moisture may follow a Gaussian curve taken across a diameter of the circular pattern having a relatively higher moisture content per unit area at the centre of the circle than towards the edges. Therefore, the circle in FIG. 9A is shown as indicative only of the general shape of the moisture pattern. In general there may also be a region of "overspray" as shown by the dashed line in FIG. 9A, where there is incidental moisture, but at a moisture level which has relatively little effect on the performance of the ironing process compared with the main wetted region of the spray pattern.

Referring to FIG. 9B, there is shown a shape of a second moisture pattern produced by a nozzle which has its main central line of symmetry tilted relative to a plane of the lower surface of the sole plate. The moisture pattern in FIG. 10B forms an elongate ellipse positioned in front of the sole plate.

Referring to FIG. 9C herein, there is shown a third possible moisture pattern formed by a mist of water emitted from a water nozzle of an iron, in which the moisture pattern forms an ellipse having its relatively longer axis aligned in a direction forward/aft of the sole plate, and positioned spaced apart from and in front of a foremost tip of the sole plate. This moisture pattern can be achieved by tilting the main central axis of the nozzle at an angle to the main plane of the fabric or sole plate which is more acute than in FIG. 9A or 9B.

For an iron having the nozzle within the perimeter footprint of the sole plate, the moisture pattern may also be substantially elliptical, or it may be circular. In that case, the moisture pattern will form under the iron, and within the area of the sole plate, and as the iron moves forward or back, the moisture will almost immediately be vapourised by the heat of the sole plate.

Figure 10:
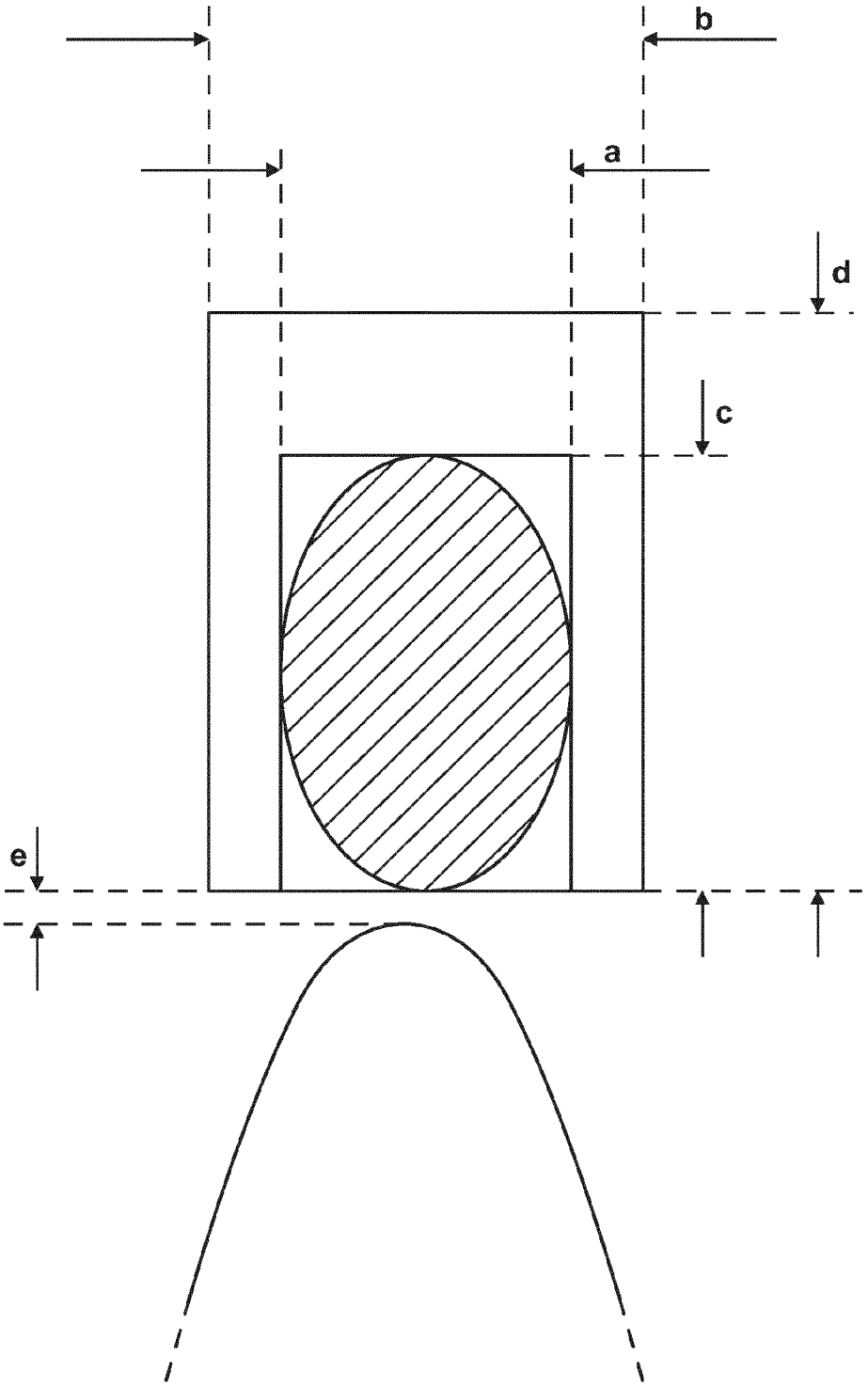
FIG. 10 illustrates schematically dimensions of a water pattern in front of a sole plate.

Referring to FIG. 10 herein, there is illustrated schematically in plan view from above a wetness or moisture pattern produced by a mist generated from a water nozzle as herein described, positioned at the front of an iron.

Figure 11:
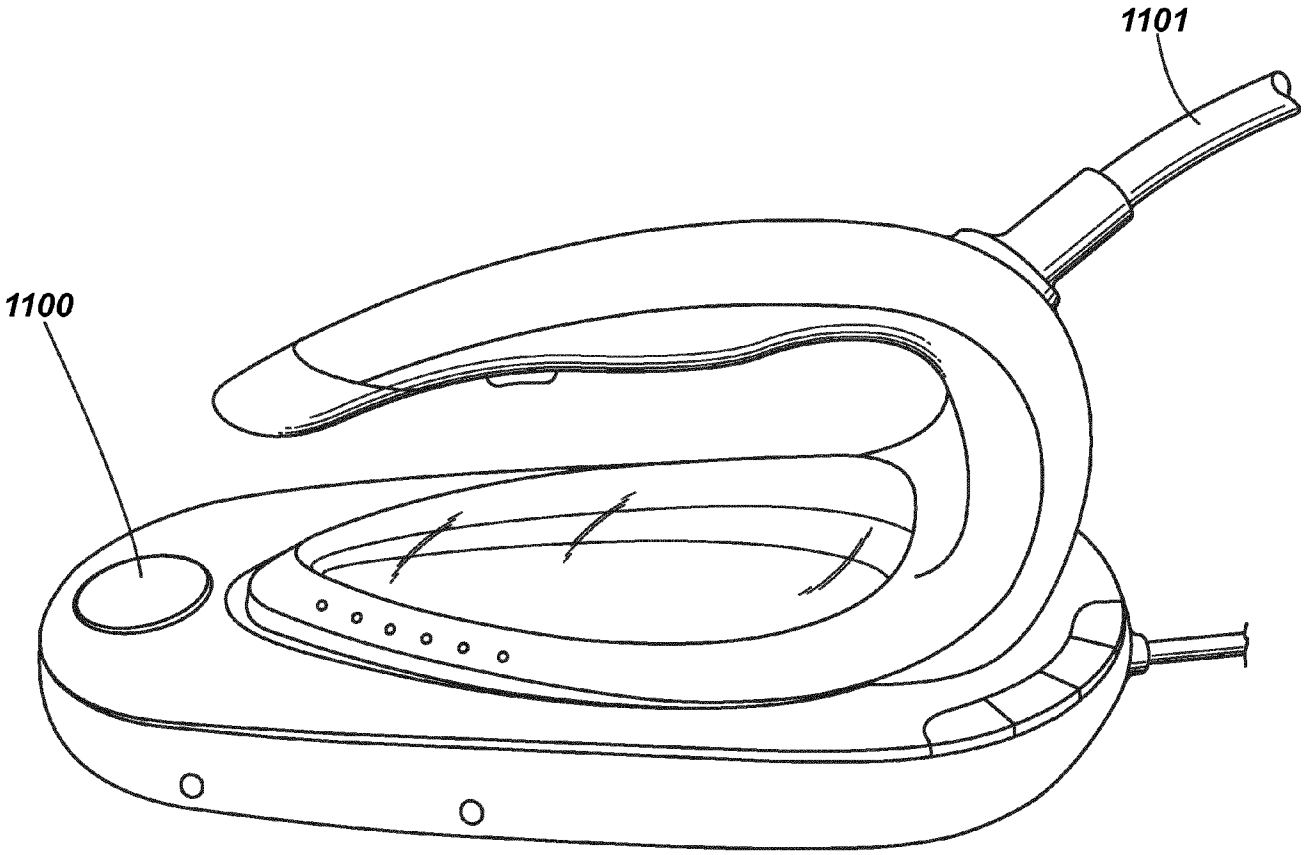
FIG. 11 illustrates schematically an iron and water station according to a fourth specific embodiment, having an improved water nozzle and a spot light function.

The water pattern comprises a generally circular or elliptical pattern positioned in front of the tip of the iron sole plate. As will be appreciated by the skilled person, the moisture pattern may not be uniformly dense over its whole area, but may become progressively less dense towards its edges. The solid lines shown in FIG. 10 represents a line of relatively equal wetness. Inside the line, the pattern may have a higher density of wetness, and outside the line, the density of wetness may reduce over spray. The line is shown for illustration purposes only to illustrate the general shape of the pattern. The area shaded shown in FIG. 11 represents an area of fabric which is moistened sufficiently for allowing efficient removal of creases during wet iron, and can be optimized experimentally through trial and error by applying different flow rates and angle of divergence of spray pattern.

Optimally, it has been found that a spray pattern having dimensions shown in FIG. 10 as follows are optimal.

Minimum width distance a—65 mm to 70 mm.

Maximum width distance b—90 mm to 95 mm.

Minimum length c—75 mm to 80 mm.

Maximum length d—100 mm to 105 mm.

The centre of the spray pattern may be positioned further away from the tip of the iron or closer towards the tip of the iron, so that the spray pattern is targeted further from the iron, or closer towards the iron. The distance e may be varied typically in the range 0 mm to 20 mm from a position directly above the tip of the sole plate by aiming or repositioning the nozzle.

Referring to FIG. 11 herein there is illustrated schematically in view from one side, a hand iron and water station according to a fourth specific embodiment. Water is supplied into a water station via a fill point 1100 covered by a filler plug. The base of the water station contains a water reservoir, and an electric pump which pumps water to the hand iron via an umbilical cord 1101. Electricity is supplied to the base of the water station, and electrical power to the hand iron is carried from the water station by a cable contained within the umbilical cord.

Figure 12:
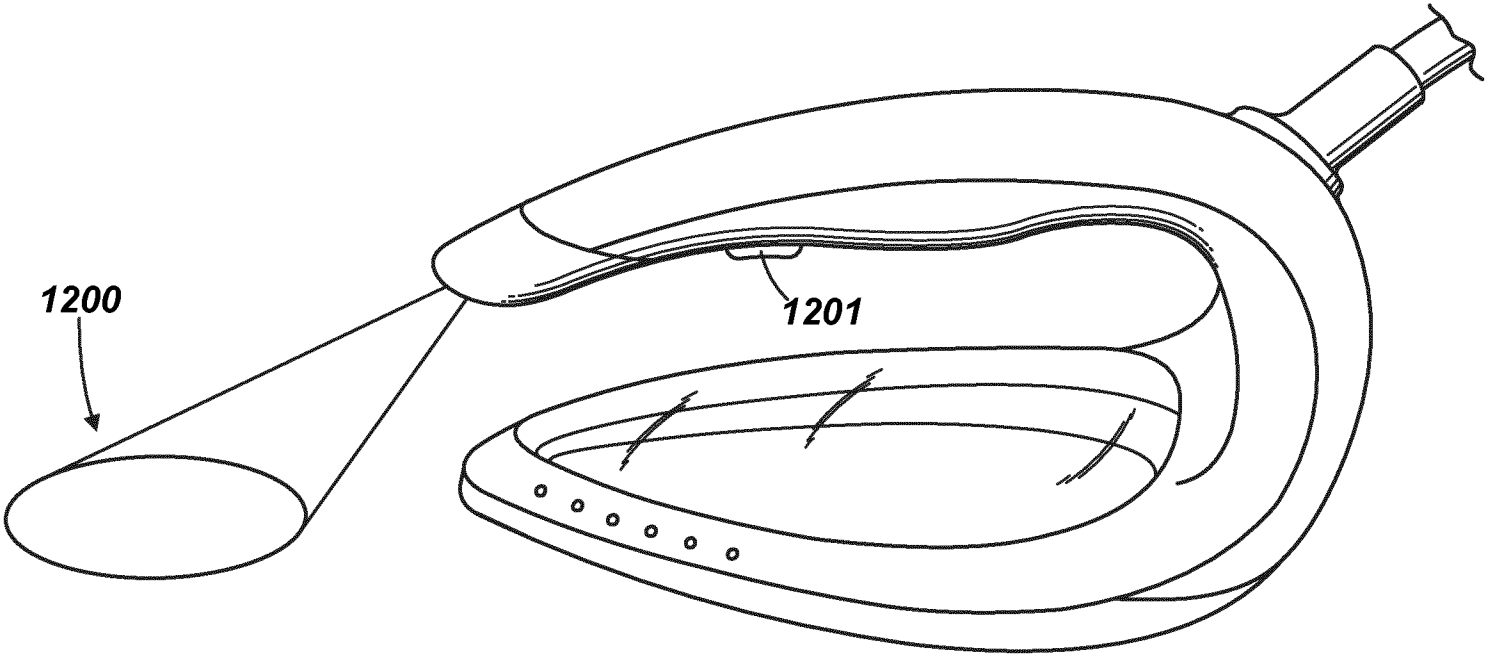
FIG. 12 illustrates schematically the hand iron of FIG. 11 herein, having a spot light illumination which shines in front of the sole plate of the iron.

Referring to FIG. 12 herein, there is illustrated schematically in perspective view from one side, the iron as shown on FIG. 11 herein. The iron comprises a water nozzle as described herein above with respect to other embodiments, and also comprises a spot light, for example in the form of a high intensity light emitting diode, or a small halogen bulb, which shines a light pattern 1300 in front of the iron. The extent of the light pattern as it falls on a horizontal fabric surface in front of the iron may be adjusted to coincide with an area of optimal spray pattern from a water nozzle located immediately adjacent to the spot light at the tip of an upper handle of the iron, so as to denote to a user the area where moisture has fallen on the fabric to be ironed.

The spotlight may be configured so as to be permanently on when the iron is in use, or may be activated at the same time as the water nozzle by a hand control 1201 immediately underneath the handle at a position to be operable by a user's forefinger.

To aid visibility for the user, the spot light may be provided in a colored light, for example light blue, light green or red, or in a normal yellow/white light.

An additional feature of the fourth embodiment is the provision of a ball and socket type joint where the umbilical cord meets the rear of the iron, allowing some flexibility of the cord as the iron moves forward and back.

The hand iron shown in FIG. 12 has a water nozzle as herein described with spray/mist patterns and spray/mist parameters as described herein before, and a spot light and control as described with reference to FIG. 5 herein.

The following variations on operating parameters and components apply to any of the embodiments as described herein:

Water Pump

A pump pressure of 4 Bar to 7 Bar is preferred, so that the pressure of water at the water nozzle is also 4 Bar to 7 Bar. Typically a AKO-MEVPY-1 type solenoid pump may give the required pressure and performance.

Filter Type

Preferably, the water filter is an in-line type water filter. Preferably the water filter is of a non-replaceable type, however in some embodiments a replaceable water filter of the "plug" type which can be manually removed or replaced in the casing of the water station may be provided.

Preferably, the filter has a mesh size or gauze size having apertures of dimension around 75 μm×150 μm (0.006"×0.003" approx), or an aperture area in the range 10,000 $\mu m^2$ to 12,500 $\mu m^2$. However, filter aperture dimensions in the range width 65 μm to 85 μm and length 100 μm to 200 μm may also be suitable.

Water Nozzle Type

The water nozzle may be similar to the type conventionally used for spray painting purposes, for example for automotive use, which gives a substantially uniform spray pattern and a relatively even density of liquid on a surface sprayed.

Water Nozzle Orientation

The orientation of the water nozzle and its aperture relative to the surface to be ironed affects the pattern of mist or vapor which is incident on the garment or fabric to be iron. The nozzle may be manufactured in its directionality to provide an optimized water pattern.

The embodiments described herein may permit generation of on-demand sprays or mists having controlled drop size, controlled area coverage, and controlled water flow rate using a compact low power low weight device. Key benefits for the ironing application may include the following:

Reduced energy consumption compared to use of conventional steam irons.

The spray, vapor, mist or aerosol can be synchronized with the users ironing movement. The response time of the water emission gives a substantially instant start/stop in response to a user control.

Small size and low weight of the components enables an integrated "on board" system for an iron.

There is reduced scaling, since in some embodiments no heating of the water is required. The moisture is provided on the fabric at room temperature, and only heated when the sole plate passes over the wetted area.

In static testing with the iron stationary, the droplet size of the water in the fine mist is in the range 50 μm to 100 μm, when the droplets are settled on a surface, and the mean settled droplet size is approximately 77 μm (0.003"). The range of droplet sizes obtained during the testing was between 39 μm and 159 μm.

The water delivery rate through a single aperture nozzle was tested to be approximately 30 ml per minute. However delivery rates in the range 25 ml to 35 ml per minute may be suitable.

Figure 13:
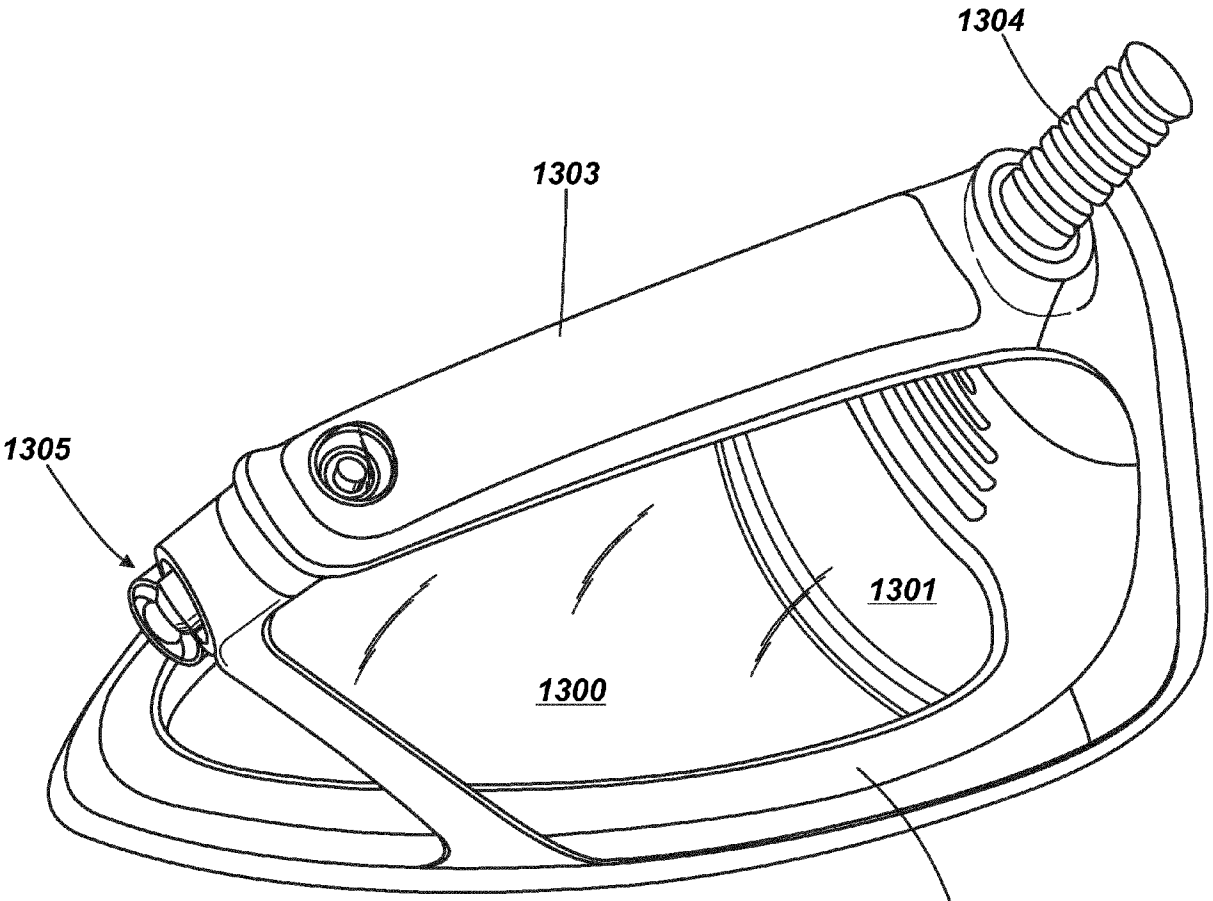
FIG. 13 illustrates schematically a fifth hand iron according to a fifth specific embodiment.

Referring to FIG. 13 herein, there is illustrated schematically in view from above and one side a fifth hand iron according to a fifth specific embodiment.

The fifth hand iron comprises a transparent see through sole plate 1400, having a metal oxide semi conductor heating element; a transparent upper cowl 1301; a casing 1302; a handle 1303; an umbilical cord 1304 comprising a hollow rubber flexible tube and an insulated electrical cable; and a water nozzle 1305, positioned at the tip of the handle and overhanging the front of the iron.

Figure 14:
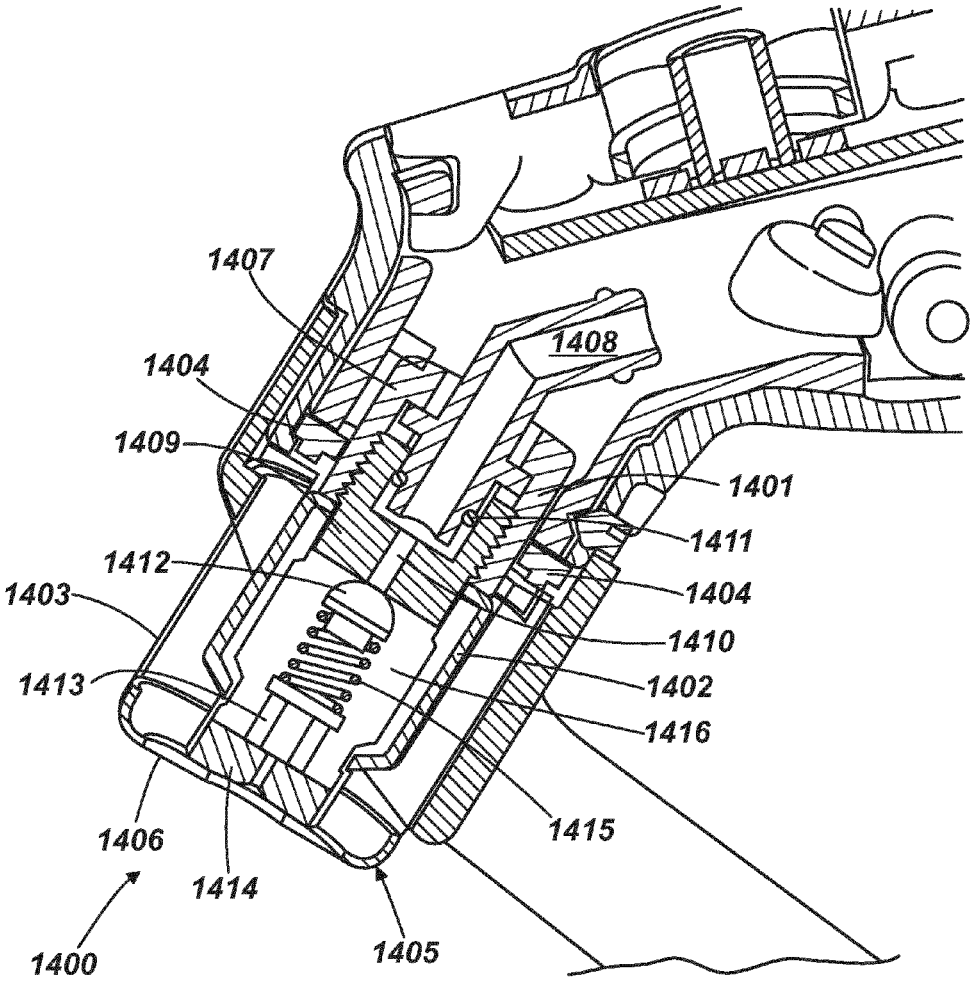
FIG. 14 illustrates schematically in cut away view, a nozzle assembly of the fifth iron.

Referring to FIG. 14 herein, there is illustrated in cut away view from one side, the water nozzle at the front of the fifth iron.

The nozzle 1400 comprises an inner nozzle assembly 1401; surrounding the inner nozzle assembly, a decorative substantially cylindrical tubular metal or plastics sheath 1402; and surrounding the nozzle and sheath, a transparent plastics or metal cylindrical tubular outer casing or shroud 1403, the arrangement being that the transparent plastics outer shroud 1403 surrounds the decorative inner metal sheath 1402, which contains the nozzle assembly 1501, there being a gap between the outer plastics shroud and the inner metal sheath 1402 which houses one or a plurality of illuminating means, for example one or a plurality of light emitting diodes 1404.

The illuminating means, when activated, shines a beam of light coincident with a spray pattern of the nozzle, to allow the user to see a "target" area for wetting of fabric in front of the iron. The one or more illuminating means 1404 may comprise for example directional light emitting diodes (LED's) which generate a colored directional beam. The light emitted from the illuminating means may pass through a front portion 1405 of the outer shroud, which may act as a lens to focus or direct a beam of light in a beam pattern in front of the iron. Additionally, since the side of the shroud 1403 may be of a transparent or translucent material, a user may be able to see through the side wall of the substantially cylindrical shroud to check that the illumination means are operating. This also gives a pleasing and attractive visual effect to the front of the iron.

The nozzle assembly 1401 comprises a substantially cylindrical body 1407, into which is connected a plastics or metal water feed pipe 1408, which feeds back through the handle of the iron via an in-line filter, to the umbilical cord, from which it receives water from a separate base station. The nozzle assembly further comprises a screw threaded insert member 1409 which screws into the body 1407, the insert member having a central bore 1410 through which water can travel under pressure. The feed pipe 1408 connects with the internal bore of the insert member 1409, and makes a water tight seal with the insert member by means of an "O" ring 1411. An outlet of the bore of the insert member 1409 is closed off by a resiliently biased dome shaped plunger 1412, which urges against the opening of the bore, and is opened under pressure from water, to allow water to pass over the surface of the plunger, and through a channeled plug member 1413. The channeled plug member has one or a plurality of channels through which water can pass, which feed the water to a cylindrical bore in a flat disc shaped nozzle outlet 1414, from which water is sprayed at the front of the iron.

The dome shaped plunger 1412 operates under bias of a spring member 1415 so as to immediately close off the water supply once the pressure drops, due to turning off the water pump, which avoids any residual drainage of water which could cause dripping out of the nozzle outlet 1414 when the spray is not activated by the user.

The plunger 1412, and plug 1413 are retained to the insert member 1409 by a hollow nut 1416.

The plunger 1412 and spring 1415 are retained to the main body by means of a hollow nut 1416.

Figure 15:
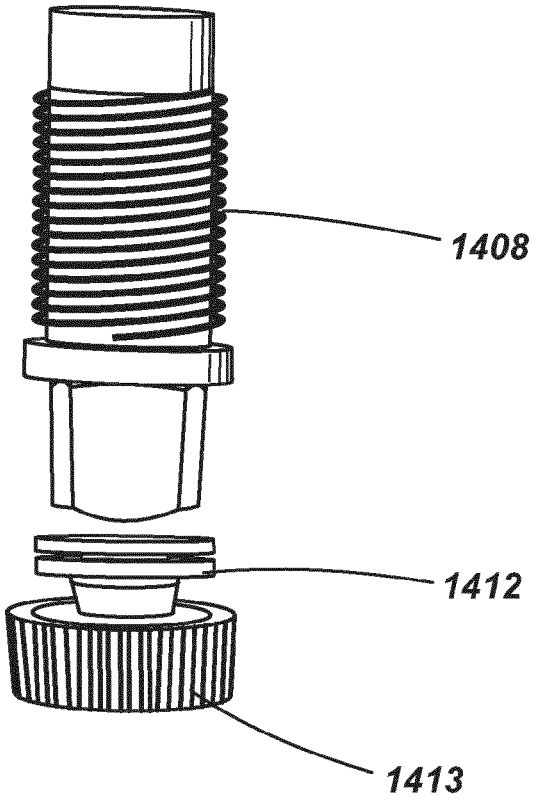
FIG. 15 illustrates schematically internal components of the nozzle assembly of the fifth iron.

Referring to FIG. 15 herein, there is illustrated schematically the insert member 1409, plug member 1413, and nozzle outlet 1414 removed from the casing 1407 for clarity.

Figure 16:
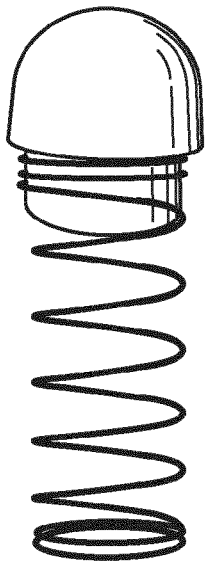
FIG. 16 illustrates schematically a plunger component of the fifth iron.

Referring to FIG. 16 herein, there is illustrated in view from one side, the dome shaped plunger 1412, and spring member 1415 removed from the remainder of the nozzle assembly.

Figure 17:
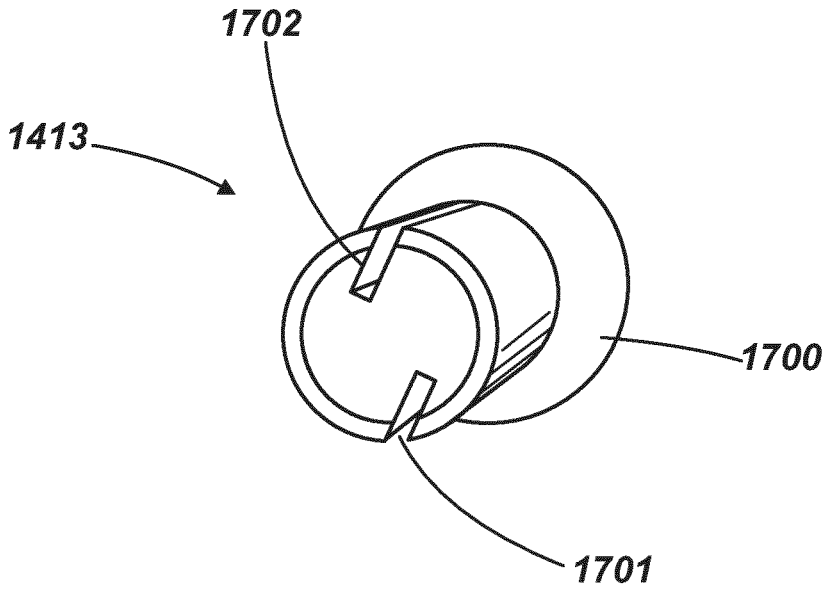
FIG. 17 illustrates schematically a plug component of the nozzle assembly of the fifth iron.

Referring to FIG. 17 herein, there is illustrated in view from one end, the substantially cylindrical metal plug member 1413. The plug comprises a solid cylindrical member having a flared upper end 1700, a pair of machined slots 1701, 1702 provide first and second water channels through which water is fed to the nozzle assembly 1414.

Figure 18:
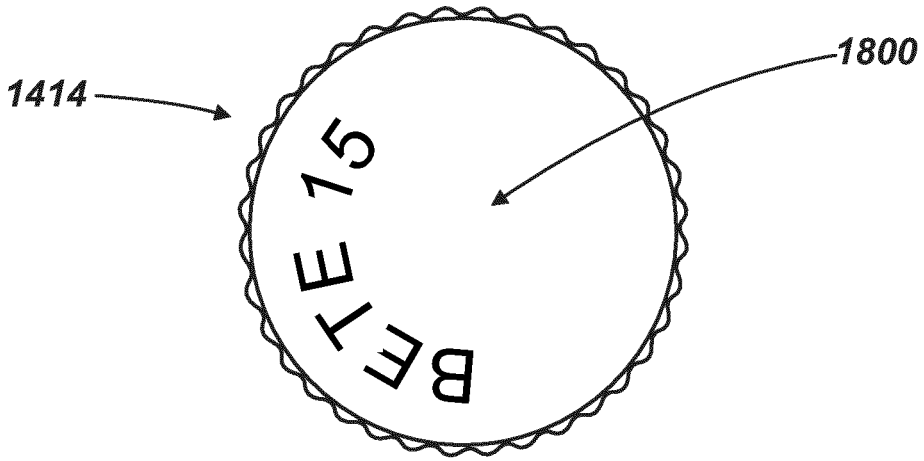
FIG. 18 illustrates schematically a nozzle outlet of the nozzle assembly.

Referring to FIG. 18 herein, there is illustrated schematically in view from one end, the nozzle outlet 1414. The nozzle outlet comprises a cylindrical disc shaped member having a centrally formed cylindrical tubular bore 1800. In the embodiment shown, the diameter of the bore is 0.03 inches (approximately 0.75 mm), which provides a suitable spray pattern, droplet size, and volume of water for wetting fabric in front of the iron.

Figure 19:
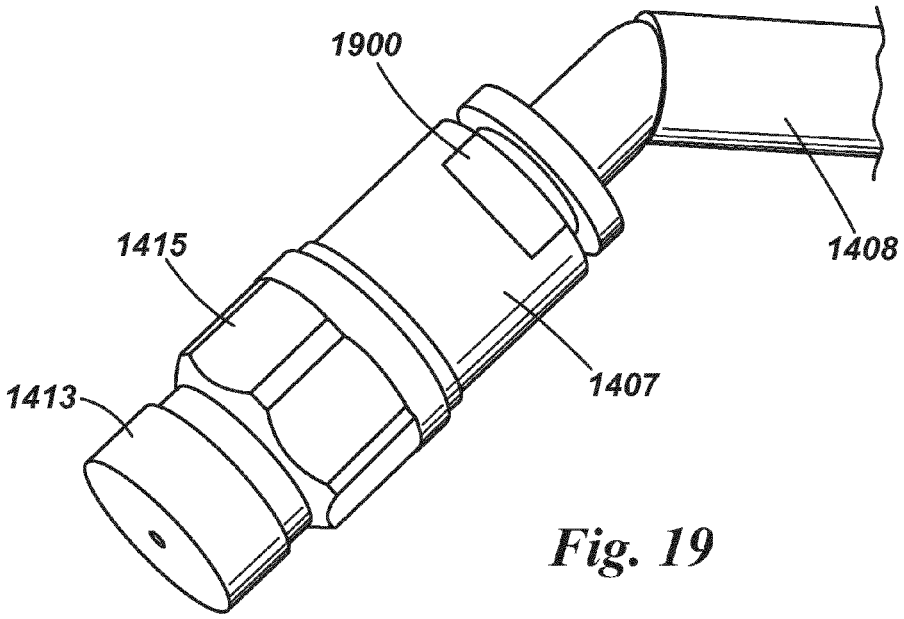
FIG. 19 illustrates schematically in external view the nozzle assembly of the fifth iron.
Figure 20:
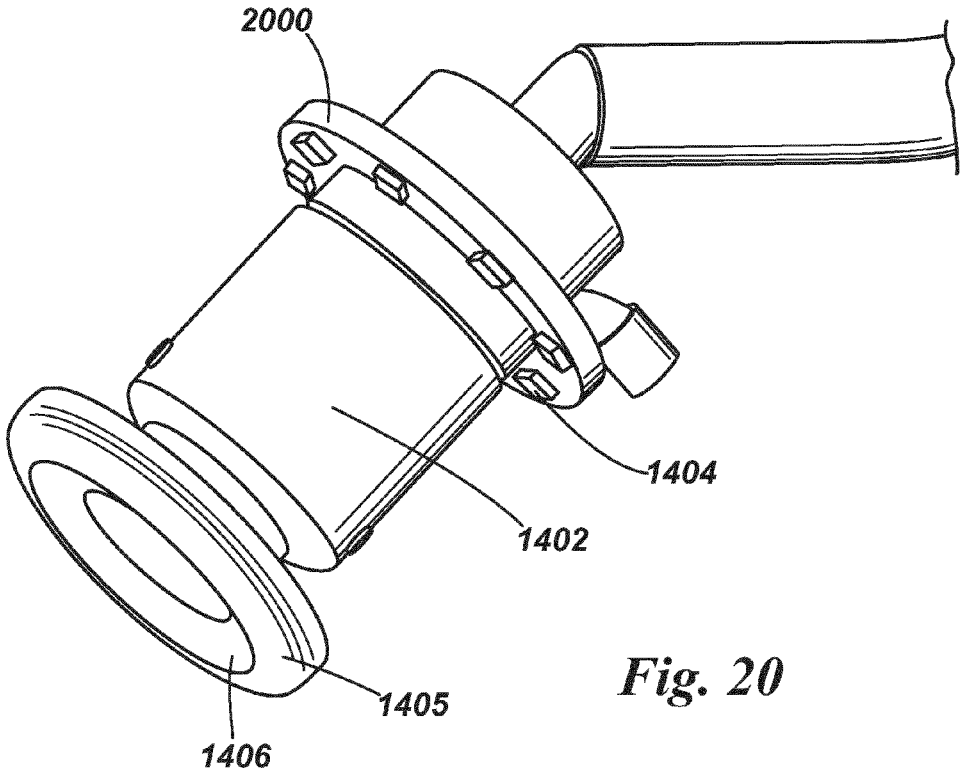
FIG. 20 illustrates schematically the nozzle assembly of the fifth iron having an external decorative sheath, and a plurality of light emitting devices with a lens.

Referring to FIG. 19 herein, there is illustrated schematically in view from one side, the complete nozzle assembly, removed from the front of the iron, together with the connecting feed pipe which supplies water to the nozzle assembly. The outer body 1407 of the assembly may have a pair of machined flat faces 1900, one each side of the otherwise substantially cylindrical casing, to allow for gripping the casing with a tool during construction of the nozzle assembly.

Referring to FIG. 2041 herein, there is illustrated schematically the nozzle assembly partially encapsulated by the decorative metal sheath 1402, and fitted with a plurality of light emitting means 1404 mounted on a ring component 2000 fitted around the upper end of the nozzle assembly.

A lower end of the nozzle assembly protrudes from the lower end 1405 of the outer casing.

Figure 21:
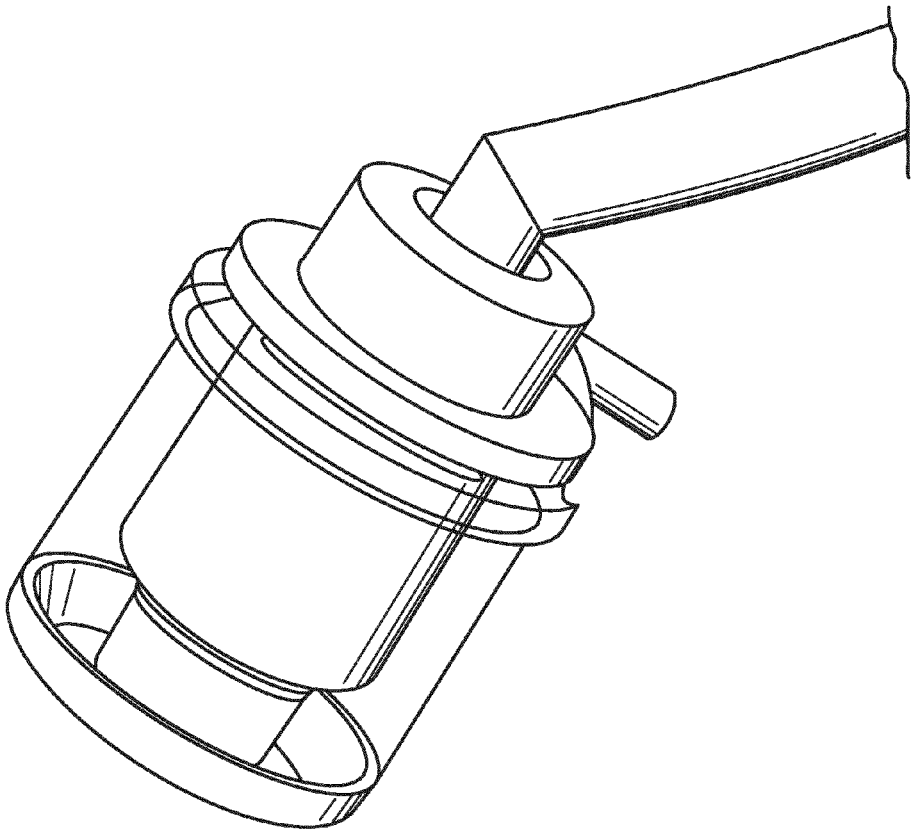
FIG. 21 illustrates schematically an external shroud covering the nozzle of the fifth iron.

Referring to FIG. 21 herein, there is shown schematically the nozzle assembly contained within the metal sheath and outer plastics casing or shroud, and connected to the water feed pipe. The user can see through the transparent or translucent outer plastics casing to view the decorative metal or plastics sheath. The space between the inner sheath and the outer casing is illuminated by the illumination means in use, producing an attractive decorative effect, as well as providing a light beam out of the end of the shroud to provide the light pattern or light spot in front of the iron.

Figure 22:
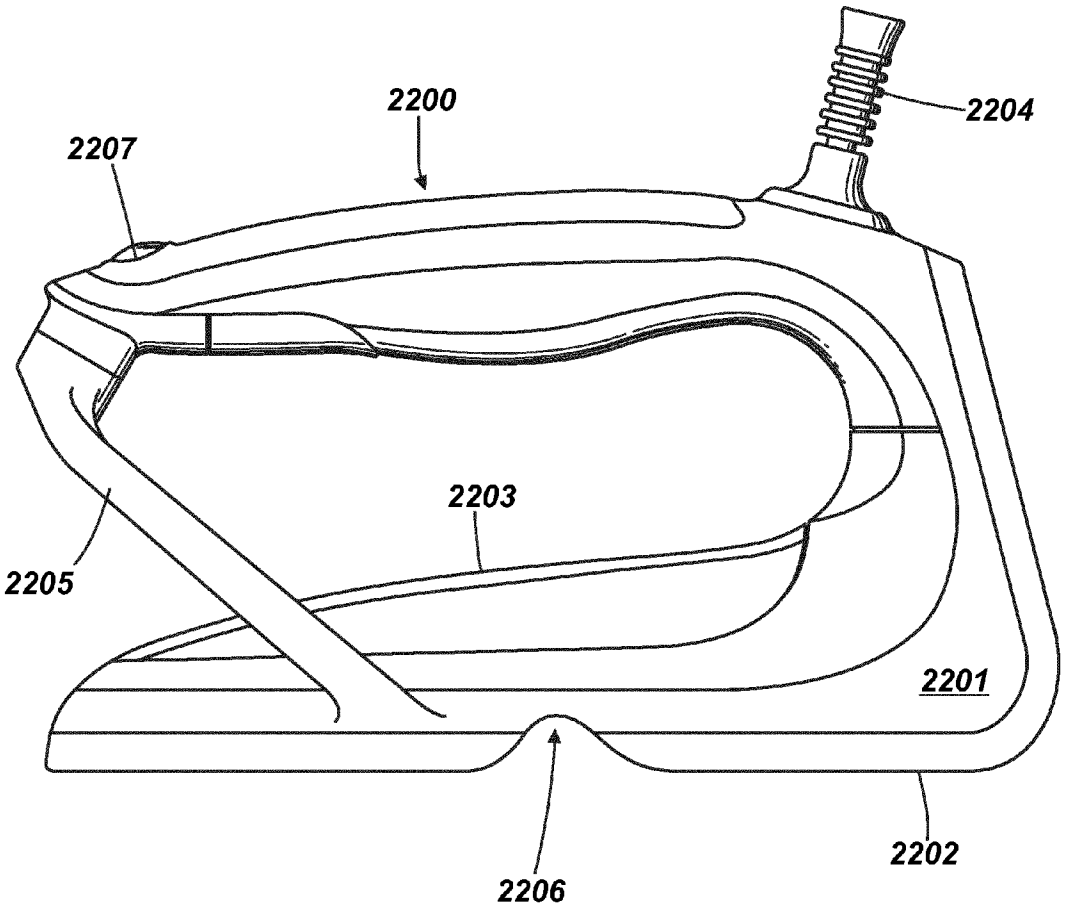
FIG. 22 illustrates schematically a sixth iron according to a sixth specific embodiment, having a plurality of spray nozzles arranged in a sole plate of the iron.

Referring to FIG. 22 herein, there is illustrated schematically in view from one side a sixth hand iron according to a sixth specific embodiment herein.

The fifth hand iron 2200 comprises an outer casing 2201 of a plastics material for example polycarbonate; a glass, ceramic or metal sole plate 2202; an upper cowl 2203 covering the sole plate; an electric heating element for heating the sole plate; an umbilical cord 2204, comprising an electric power supply cable for supplying electrical power to the iron and a rubber tube for supplying water; one or a plurality of support spars 2205 connecting the front of the iron casing to a front portion of the handle; and a vapor or mist creating water nozzle 2206 positioned within the body of the iron, so as to create a mist or spray which contacts the surface to be ironed.

The sixth hand iron further comprises a set of internal components as described substantially with reference to FIG. 5 herein including a water reservoir, a water filter, a water pump, a water valve, a control circuit and switch for activating the water pump to emit a mist from the one or more nozzles 2206; a user operable switch; and an indicator 2207 for indicating a temperature condition of the sole plate.

Figure 23:
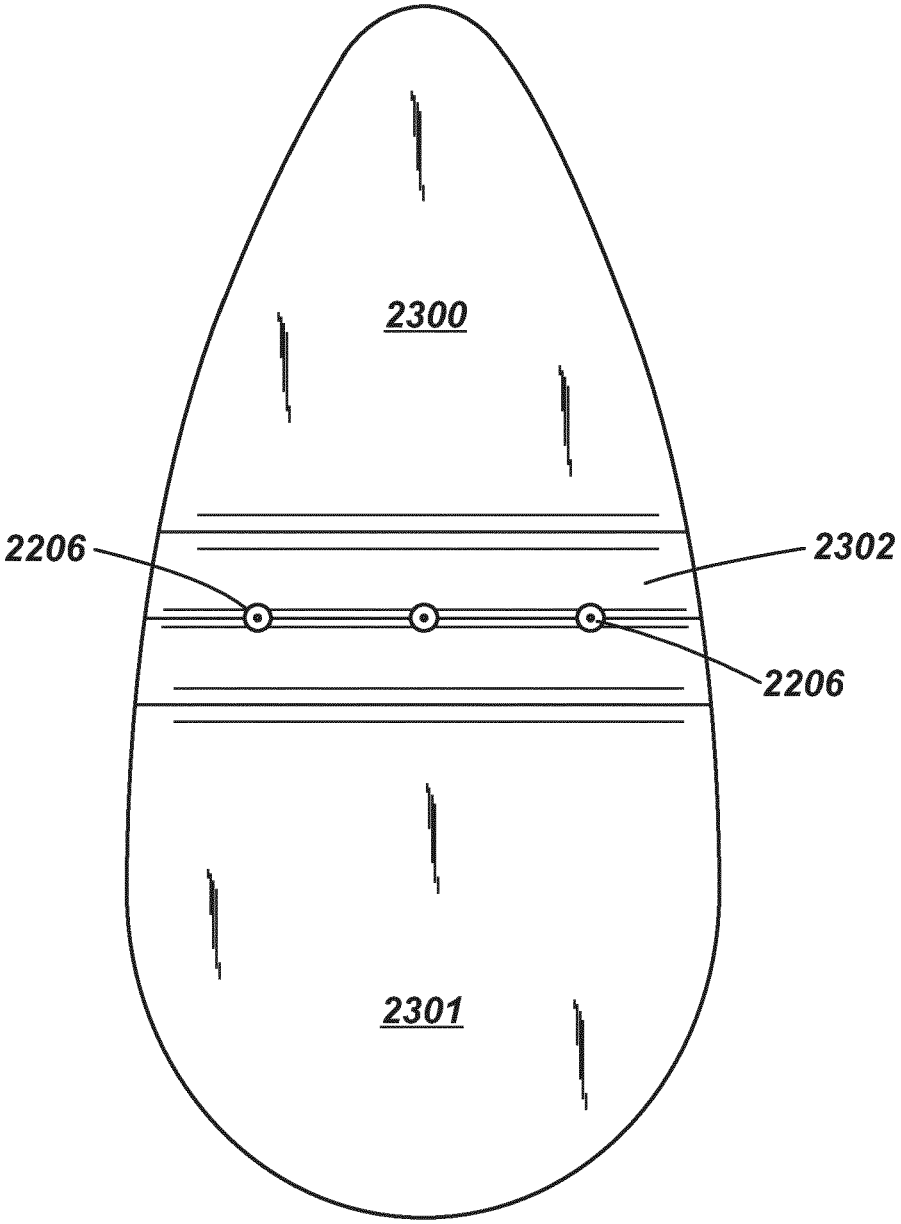
FIG. 23 shows the sixth iron of FIG. 22 in view from underneath.

Referring to FIG. 23 herein, there is shown in view from underneath the sole plate of the sixth iron.

The fifth hand iron has a recessed concave channel extending all the way across the sole plate, which forms a chamber above the surface to be ironed, there being flat regions of the sole plate in front of the recessed channel and to the rear of the recessed channel. The sole plate is formed such that the recessed channel forms a "hump" within the sole plate, providing an elongate inverted valley shaped chamber in the sole plate.

At a roof of the chamber, there are provided a plurality of water nozzles arranged in a line across the width of the sole plate. As the iron moves backwards and forwards, a water mist is emitted from the nozzles, under control of the user in order to wet a garment or fabric being ironed. The active heated part of the sole plate is portioned into a front region 2300, and a rear region 2301, separated by the central valley 2302. As the iron moves forwards, water spray emitted by the nozzles wets the fabric immediately under the chamber in the sole plate, and the hot rear portion of the iron 2301 evaporates the water to create steam as it passes over the fabric. Similarly, when the iron is drawn backwards, water emitted by the plurality of nozzles 2206 and which has settles on the fabric is evaporated by the front portion 2300 of the sole plate.

Figure 24:
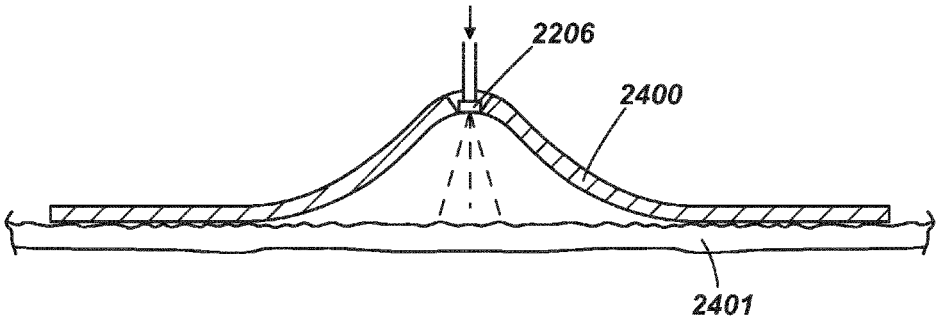
FIG. 24 shows schematically in view cut away a portion of the sole plate of the sixth iron.

Referring to FIG. 24 herein, there is illustrated schematically in cut away view, a portion of the sole plate viewed from one side in contact with a fabric or garment 2401 to be ironed. Each nozzle generates a fan shaped blade of mist, having its main axis in a direction transverse to a fore-aft main central axis of the sole plate extending between the tip of the sole plate and the rear of the sole plate, so that as the iron moves forwards or backwards, the blade of mist uniformly coats the fabric with moisture across the full width of the sole plate.

The plurality of nozzles arranged side by side in a direction transverse to the normal direction of travel of the iron over the fabric provide a curtain of mist which settles on the fabric, substantially within the footprint of the sole plate of the iron. As the iron moves forward, a continuous layer of moisture settles on top of the fabric, which is then heated by the front or rear portions of the sole plate, depending upon a direction of travel of the iron.

Figure 25:
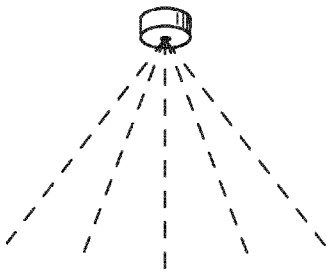
FIG. 25 illustrates schematically a nozzle and mist pattern of the sixth iron.

Referring to FIG. 25 herein, there is illustrated schematically a general shape of the fan shaped blade of water mist which is generated by a nozzle in the sixth embodiment iron.

Figure 26:
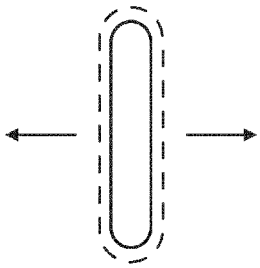
FIG. 26 illustrates schematically in plan view, a wetness pattern produced by a nozzle of the sixth iron.

Referring to FIG. 26 herein, there is illustrated schematically in view from above the shape of a wetness or moisture pattern generated by the mist generated by a nozzle 2206, when the iron is stationary. As the iron moves forwards or backwards, the moisture pattern moves forwards or backwards with the iron in the direction shown arrowed.

In some embodiments above, there has been described a ring of a plurality of light emitting means, for example light emitting devices. However, in other embodiments, a single light emitting device may be provided to produce a beam of light projecting forwardly of the front of the iron and coincident with a zone which is occupied by moisture from the nozzle when the pump is activated.

The invention claimed is:

1. An electric hand iron and water station comprising:
an electrically heated sole plate;
a water nozzle directed in front of the iron to form a water mist in front of a tip of the sole plate;
an electric pump for supplying water to said nozzle;
said water station being separate from said hand iron, said water station comprising a water reservoir for supplying water to said iron;
wherein said water nozzle is arranged to produce said water mist having a substantially uniform distribution of water droplets,
said water mist being produced without steam; and
wherein neither said electric hand iron nor said water station comprises a steam generator.

2. The iron as claimed in claim 1, wherein said water nozzle is arranged to produce a water mist which, when settled on a surface to be ironed, produces a layer of moisture on top of said surface of a substantially uniform of thickness.

3. The iron as claimed in claim 1, wherein said nozzle is positioned relative to a foremost point of the soleplate so that the midpoint of said nozzle is positioned in front of the foremost point of the soleplate.

4. The iron as claimed in claim 1, wherein said nozzle produces a mist having an average droplet diameter in the range 39 μm to 159 μm.

5. The iron as claimed in claim 1, wherein said nozzle has an outlet aperture with a maximum diameter in the range of 0.6 mm to 0.8 mm.

6. The iron as claimed in claim 1, wherein said water nozzle produces a mist having an average droplet diameter in the range 58 um to 100 um.

7. An electric hand iron comprising:
an electrically heated sole plate;
a water nozzle directed in front of the iron to form a water mist in front of a tip of the sole plate;
an electric pump for supplying water to said nozzle;
said water station being separate from said hand iron, said water station comprising a water reservoir for supplying water to said iron;
wherein said water nozzle is arranged to produce said water mist having a substantially uniform distribution of water droplets;
said water mist being produced without steam; and
an in-line filter having a mesh aperture size having dimensions in the range:
Width: 65 μm to 85 μm;
Length: 110 μm to 200 μm.

8. The iron as claimed in claim 1, wherein said mist forms a substantially elliptical spray pattern on a flat surface parallel with an underside of said sole plate, said substantially elliptical pattern being positioned in front of a tip of said sole plate.

9. The iron as claimed in claim 1, wherein said mist forms a substantially elliptical spray pattern on a flat surface parallel with an underside of said sole plate, said substantially elliptical pattern being positioned in front of a tip of said sole plate wherein said elliptical spray pattern has an area with dimensions in the range:
minimum width 65 mm to 70 mm;
maximum width 90 mm to 95 mm;
minimum length 75 mm to 80 mm;
maximum length 100 mm to 105 mm.

10. The iron as claimed in claim 1, wherein said nozzle is positioned above a tip of said sole plate, and a midpoint of the said nozzle is positioned a distance of between 5 mm and 15 mm in front of a foremost point of said sole plate.

11. The iron as claimed in claim 1, wherein said nozzle is positioned above a tip of said sole plate at a height in the range 75 mm to 80 mm.

12. The iron as claimed in claim 1, comprising a valve which opens when an inlet water pressure rises above a predetermined level, and which shuts when said water pressure drops below said pre-determined level.

13. The iron as claimed in claim 1, comprising a flexible water pipe or delivery tube, wherein water is supplied from said water station to said hand iron via a flexible pipe or tube.

14. The iron as claimed in claim 1, wherein said nozzle operates at a flow rate in the range 25 milliliters to 30 milliliters per minute.

15. The iron as claimed in claim 1, wherein said nozzle operates at a pressure within the range 4 bar to 7 bar.

16. An electric hand iron comprising:
an electrically heated sole plate;
a water nozzle directed in front of the iron to form a water mist in front of a tip of the sole plate;
an electric pump for supplying water to said nozzle;
said water station being separate from said hand iron, said water station comprising a water reservoir for supplying water to said iron;
wherein said water nozzle is arranged to produce said water mist having a substantially uniform distribution of water droplets;
said water mist being produced without steam; and
a pressure regulator for regulating a pressure of water supplied to said nozzle.

17. The iron as claimed in claim 1, further comprising an electrically operated illumination means positioned so as to shine a light spot or pattern in front of said sole plate at a position coincident with a position of said mist pattern.

* * * * *